US005211191A

United States Patent [19]

Brown

[11] Patent Number: 5,211,191

[45] Date of Patent: May 18, 1993

[54] DISHWASHER BAG

[75] Inventor: Marilyn Brown, Van Nuys, Calif.

[73] Assignees: Linda Dmytryk; Carol Zelden, Los Angeles, Calif. ; a part interest to each

[21] Appl. No.: 881,642

[22] Filed: May 12, 1992

[51] Int. Cl.[5] ..... B08B 3/02

[52] U.S. Cl. ..... 134/201; 68/235 R; 383/34; 220/493

[58] Field of Search ..... 134/84, 135, 201; 220/493, 9.1, 404, 487, 495, 485, 9.2, 489, 641; 68/235 R, 213; 383/34

[56] References Cited

U.S. PATENT DOCUMENTS

| | | | |
|---|---|---|---|
| 2,225,089 | 12/1940 | Vadnais | 68/235 R |
| 2,283,488 | 5/1942 | Cox | 220/493 |
| 2,342,067 | 2/1944 | Turner | 68/235 R |
| 3,065,621 | 11/1962 | Sam | 68/181 R X |
| 3,769,819 | 11/1973 | Contreras | 68/235 R X |
| 3,935,958 | 2/1976 | Frangos | 134/84 X |
| 4,732,291 | 3/1988 | McConnell . | |
| 4,972,355 | 11/1990 | Rymoen | 134/201 |

FOREIGN PATENT DOCUMENTS

| | | | |
|---|---|---|---|
| 2224926 | 5/1990 | United Kingdom | 134/135 |

*Primary Examiner*—Frankie L. Stinson
*Attorney, Agent, or Firm*—Rapkin, Gitlin & Moser

[57] ABSTRACT

A dishwasher bag for use in combination with an automatic dishwashing machine to ensure a thorough cleansing of small objects and articles of a fragile or delicate nature. The bag is principally comprised of an open mesh material with a large opening at the top to accommodate the convenient insertion and removal of the objects to be cleansed. The opening usually spans the approximate length of the bag and is designed to be placed and cleaned inside. The opening is reinforced usually with a rigid frame and includes a cover element with a plurality of openings to allow water to penetrate from the top. The cover is connected to the bag by one or more hinges affixed to one side of the rigid frame and includes a clasp or similar type of device to secure the cover when closed.

2 Claims, 3 Drawing Sheets

DISHWASHER BAG

FIELD OF THE INVENTION

The present invention relates generally to a novel and improved dishwasher bag, and more particularly to a bag for safely and efficiently washing small objects or articles of a delicate or fragile character, such as baby bottle nipples, baby pacifiers, small baby toys and the like.

DESCRIPTION OF THE PRIOR ART

Bags for laundering clothing, fabric and related items have been in use and known in the prior art for many years. Notably absent in the prior art, however, is a device for use with an automatic dishwasher to thoroughly and safely cleanse fragile and delicate articles of a different kind, such as nipples for baby bottles, baby pacifiers, small baby toys and items of a similar size and character. Until now, small or fragile objects of the types previously described either were washed by hand or placed inside the utensil compartment of the dishwasher for cleaning. Articles placed in the utensil compartment of an automatic dishwasher are often subjected to contact with an array of sharp or pointed metal objects, such as knives and forks, which are capable of poking holes or cutting into or through the delicate or fragile material from which these articles are usually made. Also, water forcefully injected inside a dishwasher from the bottom of the unit when the unit is operational will usually cause these small objects to be propelled uncontrollably about the main compartment. The scattered objects are not only difficult to retrieve, as they are often found resting in some tight, obscure place inside the unit, they sometimes are discovered damaged as a result of their forceful random contact with the pointed and sharp articles held within the utensil compartment. Simply employing an open mesh bag to hold and properly cleanse these small or fragile articles is normally insufficient given that the bag is unreinforced and will usually collapse if not supported upright.

A collapsed bag makes it much more difficult for the water swirling around inside the dishwasher to provide a thorough and effective cleansing of the small articles inside, since the openings in the mesh tend to overlap one another and, thus, restrict the water flow therethrough. The need has arisen to develop a dishwasher bag that includes the means to maintain itself in an uncollapsed state to enable the water to easily penetrate the mesh and reach the articles inside to achieve a complete cleansing.

Thus, the present invention resolves the problems associated with the devices and methods in the prior art by providing a dishwasher bag comprised substantially of a resilient open mesh material and a reinforced opening and closure at the top that helps to maintain the otherwise resilient container in an uncollapsed state inside the dishwashing machine.

SUMMARY OF THE INVENTION

The present invention provides for a dishwasher bag for use in combination with an automatic dishwashing machine to ensure a thorough cleansing of small objects or articles of a fragile or delicate nature. The bag is principally comprised of an open mesh material with a large opening at the top to accommodate the convenient insertion and removal of the objects to be cleansed. The opening usually spans the approximate length of the bag and is designed to be as wide as necessary to accommodate the size of the articles to be placed and cleaned inside. The opening is reinforced usually with a rigid frame made of any common synthetic material, and includes a cover element with a plurality of openings to allow water to penetrate from the top. The cover is connected to the bag by one or more hinges affixed to one side of the rigid frame and includes a clasp or similar type of device to secure the cover when closed.

The water circulating inside the dishwasher will not permeate the mesh bag sufficiently to thoroughly cleanse the objects inside if the bag is allowed to collapse in on itself. To prevent this condition from occurring, the rigid frame and cover element combine to provide the means to maintain the otherwise resilient and unconstructed container in an uncollapsed or upright state. One means to achieve this is to place the mesh portion of the bag on top of one of the racks situated inside the dishwasher and, using multiple openings in the cover, hook the cover over one or more of the bent prongs extending generally vertically therefrom.

Accordingly, an object of the present invention is to provide a resilient container for use in combination with an automatic dishwashing machine to hold and thoroughly cleanse small objects and delicate articles.

Another object of the present invention is to provide a container for use in combination with an automatic dishwashing machine that is comprised primarily of a resilient mesh material having a reinforced opening and a cover to provide the means to maintain the otherwise resilient and unconstructed container in an upright state on a rack inside the machine.

Still yet another object of the present invention is to provide a resilient mesh container for use in combination with an automatic dishwashing machine to hold and cleanse small and delicate objects that can be detachably mounted and supported upright on a rack inside the machine.

Still yet another object of the present invention is to provide a resilient mesh container for use in combination with an automatic dish washing machine to hold and cleanse small and delicate objects that is easy to manufacture and convenient to use.

Other objects and advantages of the present invention will become apparent in the following specifications when considered in light of the attached drawings wherein the preferred embodiment of the invention as illustrated.

DETAILED DESCRIPTION OF THE PREFERRED EMBODIMENT

Figure 1:
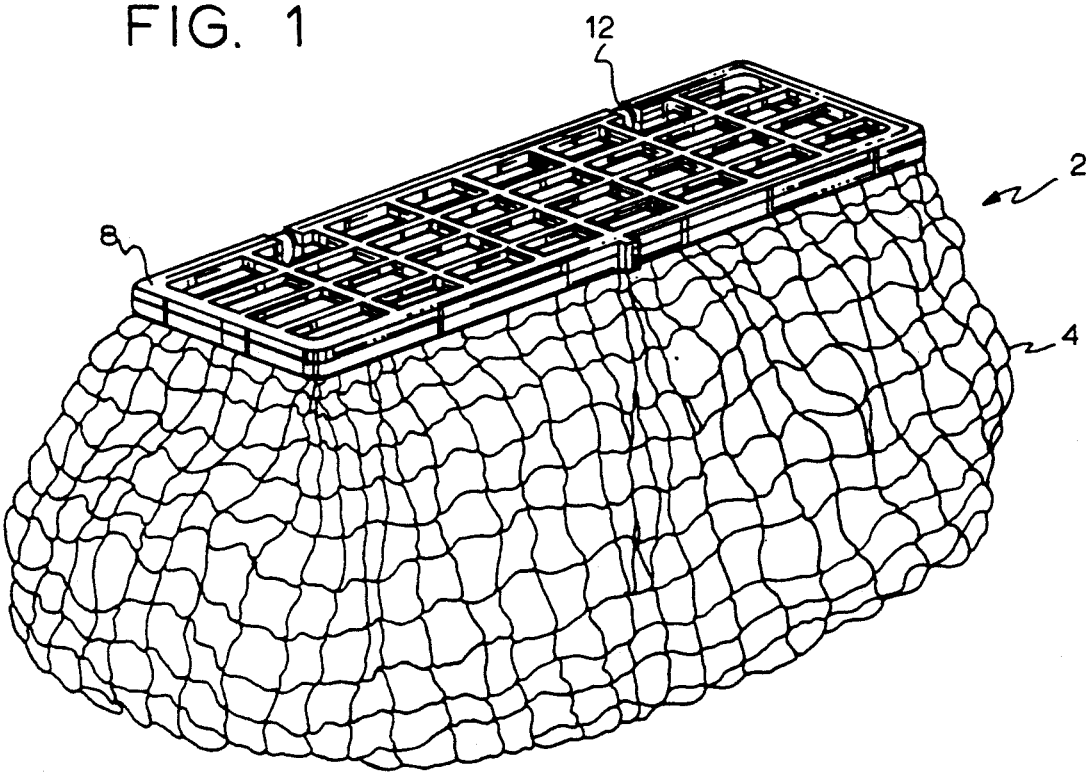
FIG. 1 is a perspective view of the dishwasher bag of the present invention.
Figure 2:
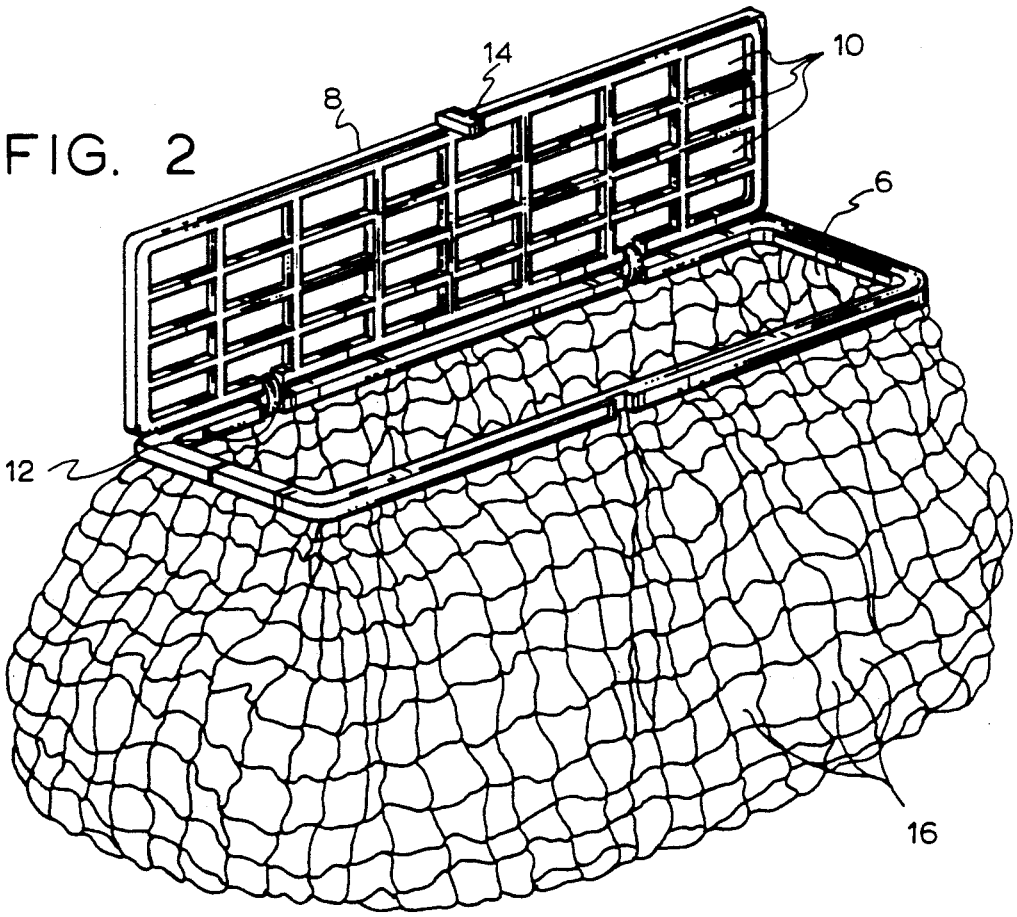
FIG. 2 is a perspective view of the dishwasher bag of the present invention with the top cover shown open.
Figure 3:
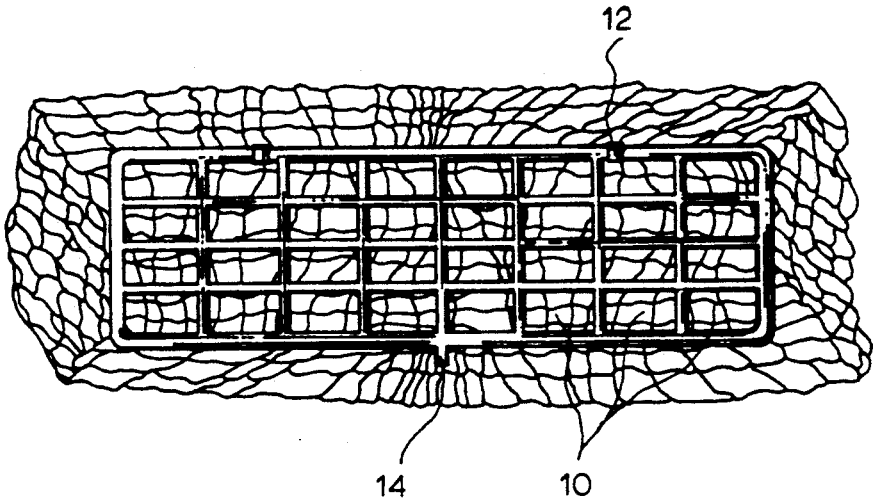
FIG. 3 is a top view of the dishwasher bag of the present invention.
Figure 4:
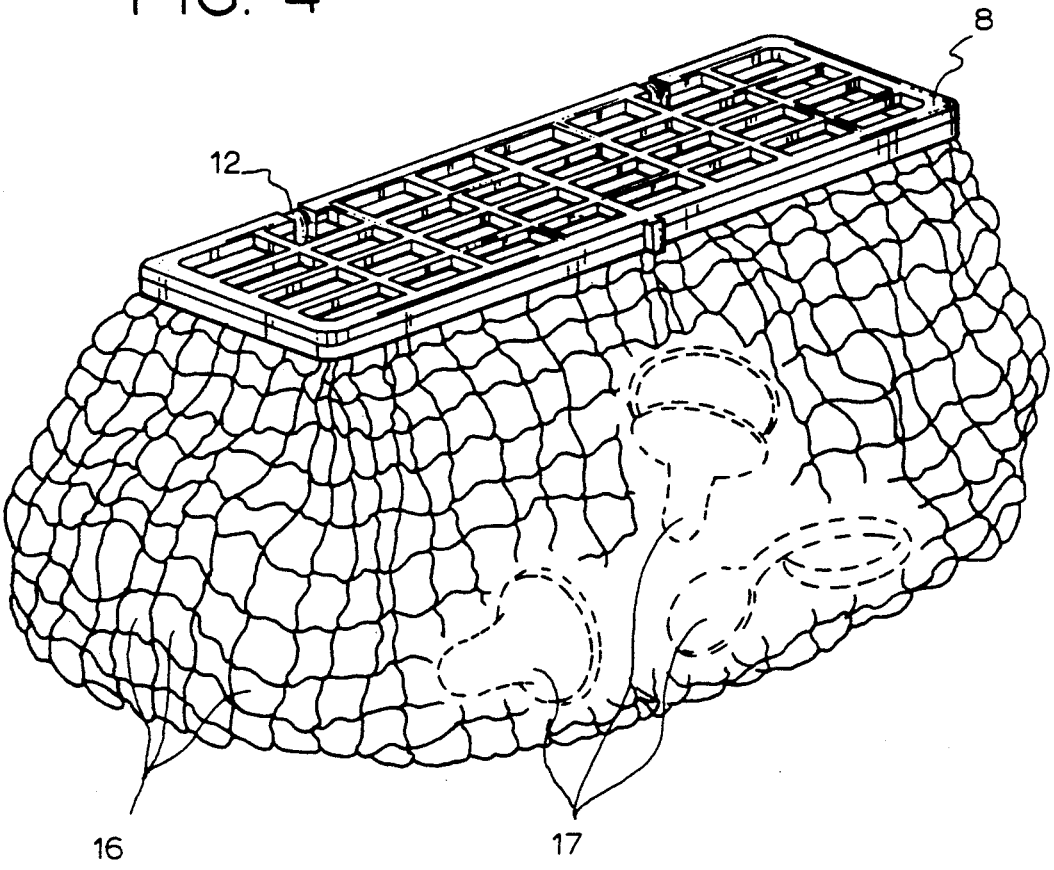
FIG. 4 is a perspective view of the dishwasher bag of the present invention containing an assortment of small objects inside shown in phantom.
Figure 5:
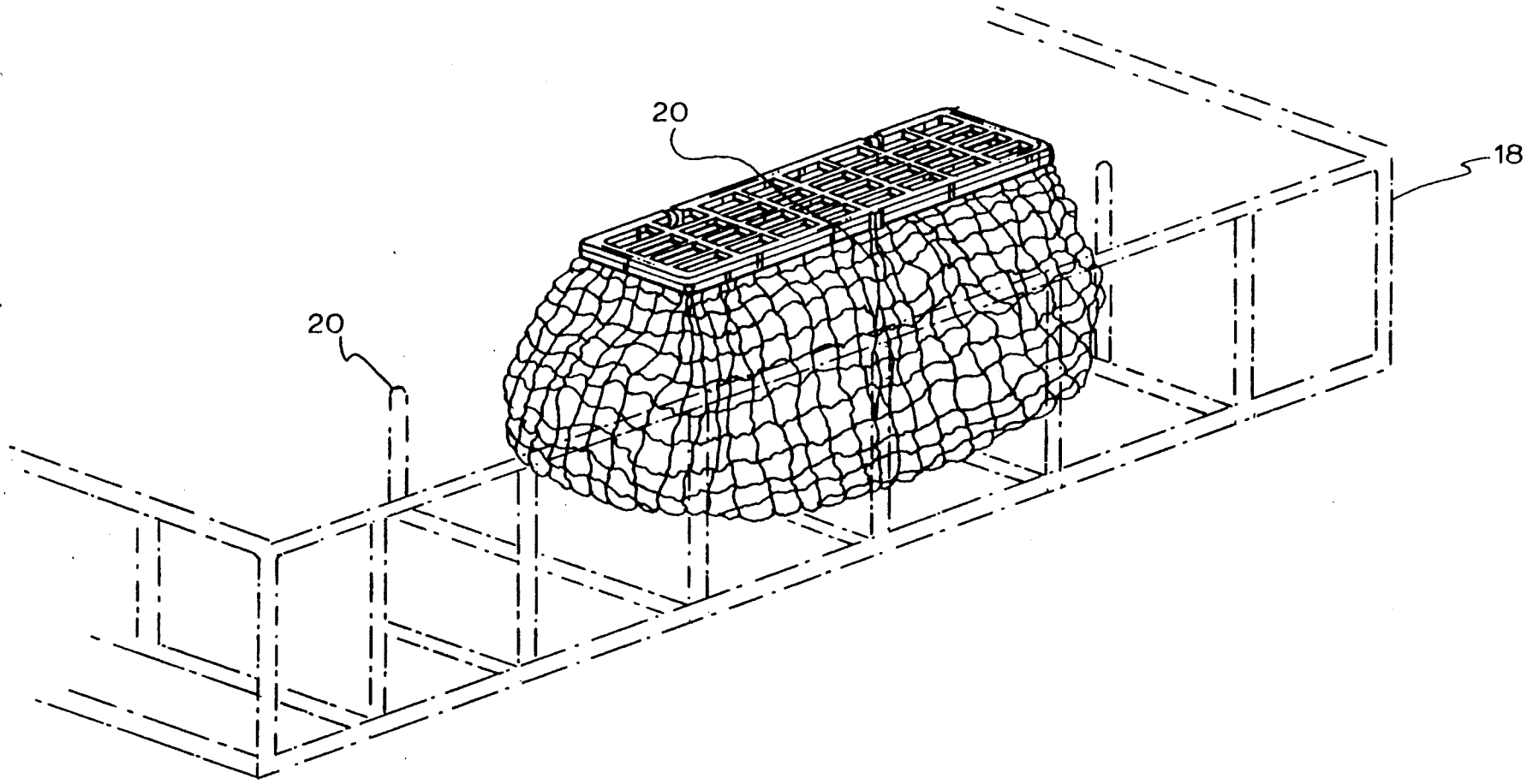
FIG. 5 is a perspective view of the dishwasher bag of the present invention depicted situated on a rack inside a dishwashing machine (not shown).

Referring more particularly to the drawings, FIG. 1. is a perspective view of the dishwasher bag 2 of the present invention in its preferred form. Bag 2 is comprised of a main compartment 4 and a rigidly framed closable opening 6 incorporated into the top section of compartment 4. Opening 6 includes a cover 8 with a plurality of openings 10 to allow water and dishwashing liquid to penetrate from the top into compartment 4. Cover 8 is attached to the opening 6 by hinges 12 or some similar mechanism utilized for this purpose. Cover 8 also includes a clasp 14 or similar type of device to enable the cover to securely attach to a portion of the framed opening 6 when the cover 8 is closed.

Compartment 4 is usually comprised of a resilient open mesh material containing a plurality of small openings 16. The opening 6 at the top of the compartment provides the access for an assortment of small objects or articles of a fragile or delicate nature to be placed inside. There the articles 17, such as tiny baby toys, pacifiers, bottle nipples and the like, are kept in a confined and protected state. Typically, the bag 2 containing the small objects is placed on one of the racks 18 situated inside a conventional automatic dishwashing machine (not shown). In order to maintain the bag in a generally upright condition, the prongs 20, which are normally slightly bent and used as the means to separate the dishware and glassware inside the dishwasher, are inserted inside one or more of the openings 10 to support the bag 2 and prevent it from collapsing. In a collapsed state, the plurality of holes 16 in the mesh material tend to overlap each other and obstruct the water from passing through the compartment 4 to clean the objects inside.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. In combination with an automatic dishwashing machine having one or more racks for containing dishware and other objects, said racks having thereon a plurality of generally vertically disposed pronged means for supporting and separating dishware, glassware and similar kinds of articles, a bag for containing and cleansing small and/or delicate objects, comprising:

a flexible mesh or net like fabric including a top end and a bottom end containing a plurality of small openings therein;

a structure therein for reinforcing said mesh or net like fabric with means to maintain said fabric in an uncollapsed state, said structure defining in said top end a generally rectangular opening having a cover means therein to close the opening for retaining the objects inside, said cover means having a plurality of openings to allow the permeation of water;

said means to maintain said fabric in a reinforced generally upright uncollapsed state comprising a plurality of openings in said cover means adapted to hook over and held up at said top and by said generally vertically oriented prongs.

2. The invention of claim 1 wherein said fabric is comprised of resilient plastic material.

* * * * *